US007416052B2

(12) United States Patent
Mabuchi et al.

(10) Patent No.: US 7,416,052 B2
(45) Date of Patent: Aug. 26, 2008

(54) EXHAUST SYSTEM OF INTERNAL COMBUSTION ENGINE

(75) Inventors: Tomoki Mabuchi, Toyota (JP); Yutaka Nozawa, Okazaki (JP); Eiji Asai, Okazaki (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 293 days.

(21) Appl. No.: 11/198,284

(22) Filed: Aug. 8, 2005

(65) Prior Publication Data

US 2006/0037814 A1 Feb. 23, 2006

(30) Foreign Application Priority Data

Aug. 20, 2004 (JP) ..... 2004-240963

(51) Int. Cl.
*F01N 7/08* (2006.01)
*F01N 1/08* (2006.01)

(52) U.S. Cl. ..... 181/272; 181/269; 181/227; 181/275; 181/251; 181/268; 181/257; 181/249; 181/253

(58) Field of Classification Search ..... 181/269, 181/272, 227, 275, 251, 257, 268, 249, 253, 181/238, 239; 60/312
See application file for complete search history.

(56) References Cited

U.S. PATENT DOCUMENTS 2,841,236 A * 7/1958 Moerke ..... 181/238
2,985,252 A * 5/1961 Morrish et al. ..... 181/239
2004/0182643 A1* 9/2004 Toyoshima ..... 181/272

FOREIGN PATENT DOCUMENTS

JP A 07-164898 6/1995
JP A 11-200854 7/1999

* cited by examiner

*Primary Examiner*—Lincoln Donovan
*Assistant Examiner*—Forrest Phillips
(74) *Attorney, Agent, or Firm*—Oliff & Berridge, PLC

(57) ABSTRACT

In an exhaust system, exhaust manifolds are connected to two banks provided in a V-type engine of a vehicle, respectively, to which front pipes each having a catalytic converter are connected to the exhaust manifolds, respectively. A muffler is provided at an exhaust downstream side of the exhaust pipes, and a rear pipe is further connected to the exhaust downstream side of the muffler. The front pipe has its rear end portion located near a through hole formed in the rear pipe. A path length of one of the front pipes from the bank to the muffler is made shorter than that of the other front pipe.

8 Claims, 4 Drawing Sheets

EXHAUST SYSTEM OF INTERNAL COMBUSTION ENGINE

INCORPORATION BY REFERENCE

The disclosure of Japanese Patent Application No. 2004-240963 filed on Aug. 20, 2004, including the specification, drawings and abstract are incorporated herein by reference in its entirety.

BACKGROUND OF THE INVENTION

1. Field of Invention

The invention relates to an exhaust system of an internal combustion engine.

2. Description of Related Art

Generally an engine (internal combustion engine) for a vehicle is provided with an exhaust system formed of such components as an exhaust pipe, a catalytic converter and a muffler arranged therein. Especially in the case where the internal combustion engine is of V type, horizontally-opposed type and the like, which has two banks, the exhaust pipe including an exhaust manifold is connected to each of those two banks such that two exhaust pipes are connected to a muffler provided at a downstream side. The structure of the aforementioned exhaust system is disclosed in, for example, Japanese Patent Application Laid-Open No. 11-200854.

In the exhaust system of the internal combustion engine as disclosed in the above-described publication, each base end portion of the exhaust pipes is connected to each of those two banks such that the exhaust gas is fed into the muffler through the respective exhaust pipes. The exhaust gas fed from each of the exhaust pipes joins within the muffler. The length of one of the exhaust pipes from its base end portion to an opening is substantially the same as that of the other exhaust pipe. The thus structured exhaust system prevents generation of noise or deterioration of the output caused by the difference in the length between those exhaust pipes owing to the limitation in the arrangement of the muffler.

Some driver or occupants of the vehicle may prefer powerful engine sound or the resultant exhaust sound, which is generated by the V-type engine or the horizontally-opposed type engine in accordance with the number of cylinders. The engine sound or the exhaust sound, accordingly may become one of key factors which drive the customer to buy the vehicle. It has been generally required, however, to reduce the engine sound or the exhaust sound as minimum as possible so as to reduce the undesired sound and vibration inside and outside the vehicle. Accordingly the above-structured system fails to allow the driver or the occupant to experience the powerful original sound of the engine or the resultant exhaust sound.

The way how the engine sound is transmitted to the muffler may vary to a certain extent depending on the length of the exhaust pipe from the bank to the muffler. In the above-structured system having the two exhaust pipes each of which has the same length, the sound quality with half order is likely to be erased, and accordingly, it is difficult to freely adjust (tune) the tone quality within the muffler.

SUMMARY OF THE INVENTION

It is an object of the invention to provide an exhaust system of an internal combustion engine that provides powerful exhaust sound generated by the internal combustion engine, for example, V-type engine, horizontally-opposed type engine and the like while allowing easy adjustment (tuning) of the exhaust sound to a desired tone quality.

According to the first aspect of the invention, an exhaust system of an internal combustion engine is provided with two banks arranged therein, a first exhaust pipe and a second exhaust pipe, each connected to the two banks respectively, a muffler connected to an exhaust downstream side of the first and the second exhaust pipes, and a third exhaust pipe connected to the exhaust downstream side of the muffler. In the above-described exhaust system, the first exhaust pipe has its path length from the corresponding bank to the muffler therein shorter than that of the second exhaust pipe, and a rear end portion of the first exhaust pipe is located near an intake port of the third exhaust pipe.

The exhaust system according to the first aspect of the invention is provided with a dual inlet type muffler, in which the first and the second exhaust pipes serve as an inlet pipe of the single muffler, and the third exhaust pipe serves as an outlet pipe. In the exhaust system, the rear end portion of the first exhaust pipe, that is, an exhaust outlet of the first exhaust pipe locates near the inlet of the third exhaust pipe connected to the exhaust downstream side of the muffler for admitting the exhaust gas. Accordingly the exhaust gas discharged from the first exhaust pipe is substantially directly led to the third exhaust pipe. Accordingly, the exhaust gas that has passed through the first exhaust pipe hardly resides in the muffler nor flows thereinto, the original sound generated by the engine is transmitted to the third exhaust pipe without deteriorating its tone quality. This makes it possible to allow the driver or occupant to experience the dynamic and powerful exhaust sound.

The length of the first exhaust pipe from the corresponding bank to the muffler is shorter than that of the second exhaust pipe such that the exhaust gas discharged from the first exhaust pipe with the shorter length may be immediately led into the third exhaust pipe, thus restraining the change in quality of the original sound generated by the engine.

In the exhaust system according to the first aspect of the invention, the second exhaust pipe may have its path length within the muffler longer than that of the first exhaust pipe within the muffler.

The above-structured exhaust system may allow the length of the path through which the exhaust gas is introduced into the third exhaust pipe via the second exhaust pipe within the muffler to be longer than the length of the path through which the exhaust gas is introduced into the third exhaust pipe via the first exhaust pipe within the muffler. Adjustment of the length of the second exhaust pipe makes it possible to adjust the sound quality with high half order to a required level. The adjustment (tuning) of the exhaust sound transmitted to the third exhaust pipe may be easily performed.

BRIEF DESCRIPTION OF THE DRAWINGS

The foregoing and/or further objects, features and advantages of the invention will become more apparent from the following description of preferred embodiment with reference to the accompanying drawings, in which like numerals are used to represent like elements and wherein.

DETAILED DESCRIPTION OF PREFERRED EMBODIMENTS

Figure 1:
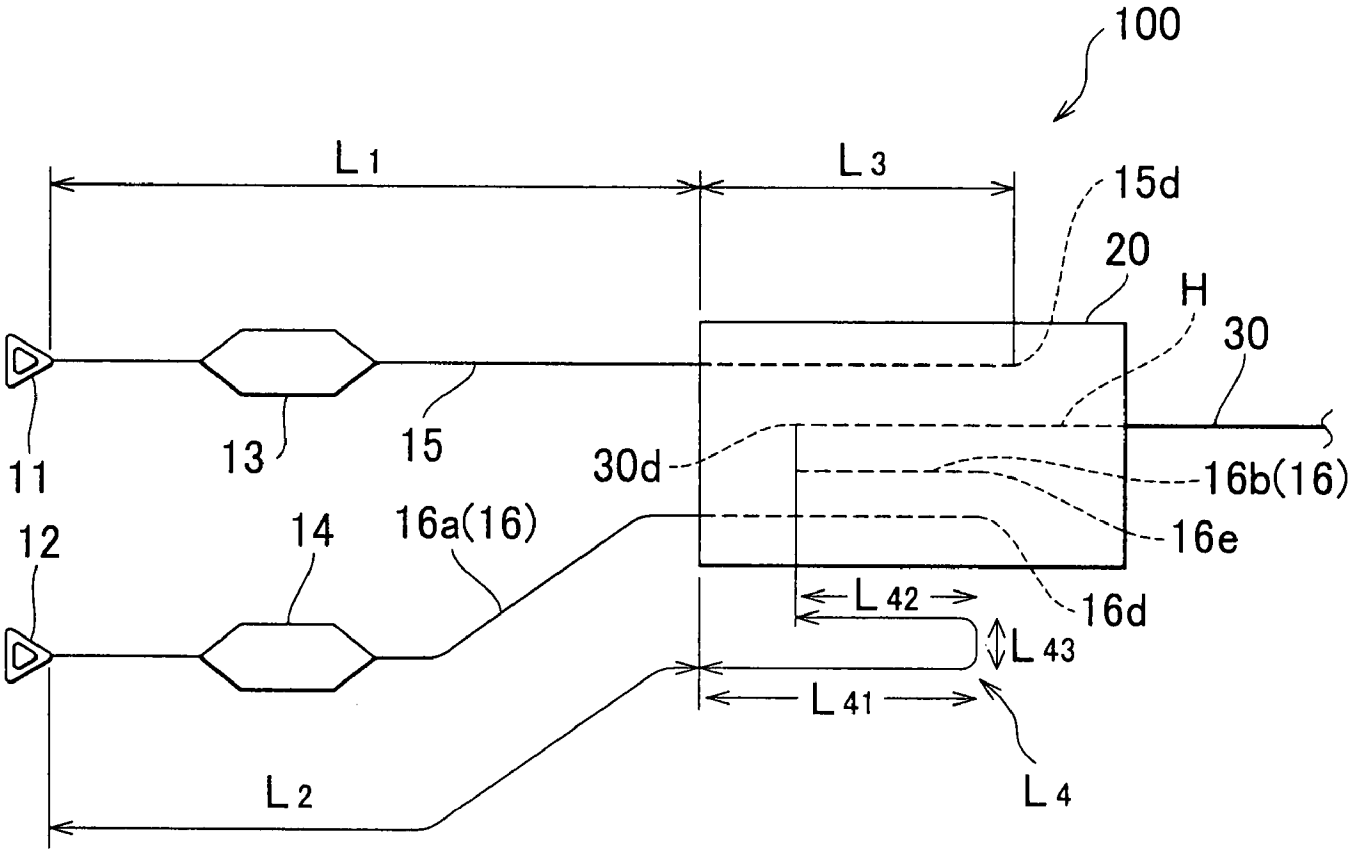
FIG. 1 schematically shows a dual type structure of an exhaust system of an internal combustion engine as a preferred embodiment according to the invention.

An embodiment of the invention will be described referring to the drawings. The identical elements will be designated with the same reference numerals, and the explanation thereof, thus, will be omitted. Unless otherwise specified, the positional relationship in the vertical and horizontal directions will be based on the one shown in the drawings. The dimension ratio of the drawing is not limited to the one shown therein.

FIG. 1 schematically shows one of preferred embodiment of an exhaust system of the internal combustion engine. An exhaust system 100 is connected to two banks, that is, a right bank and a left bank (not shown) of a V-type engine mounted on the vehicle. Each of those banks is connected to exhaust manifolds 11 and 12, respectively so as to be communicated with a plurality of cylinders provided for the respective banks. Each of the exhaust manifolds 11 and 12 is connected to a front pipe 15 (first exhaust pipe) and a front pipe 16 (second exhaust pipe) in which catalytic converters 13 and 14 for purifying the exhaust gas are provided therein, respectively.

A muffler 20 is provided downstream of the front pipes 15, 16 such that the respective end portions of the front pipes 15, 16 extend to the inside of the muffler 20. The downstream of the muffler 20 is connected to a rear pipe 30 (third exhaust pipe), a front end portion of which extends in the muffler 20. In the embodiment, the front pipe 15 is formed of a single tubular member, and the front pipe 16 is formed of a dual type tubular member including a pipe 16*a* in which the catalytic converter 14 is provided halfway, and a pipe 16*b* provided within the muffler 20.

Each length of the front pipes 15 and 16 is set so as to satisfy the following relationships:

$$L1<L2 \quad (1)$$

$$L3<L4 \quad (2)$$

where L1 refers to a length of the front pipe 15 from the exhaust manifold 11 connected to the bank to the muffler 20, and L2 refers to a length of the front pipe 16 from the exhaust manifold 12 connected to the bank to the muffler 20. L3 refers to a length of the front pipe 15 within the muffler 20, and L4 refers to the length of the front pipe 16 within the muffler 20 to satisfy the following relationship.

$$L4=L41+L42+L43 \quad (3)$$

where L41 refers to the length of the pipe 16*a* within the muffler 20; L42 refers to the length of the pipe 16*b* within the muffler 20, and L43 refers to the distance between the pipes 16*a* and 16*c*.

Figure 2:
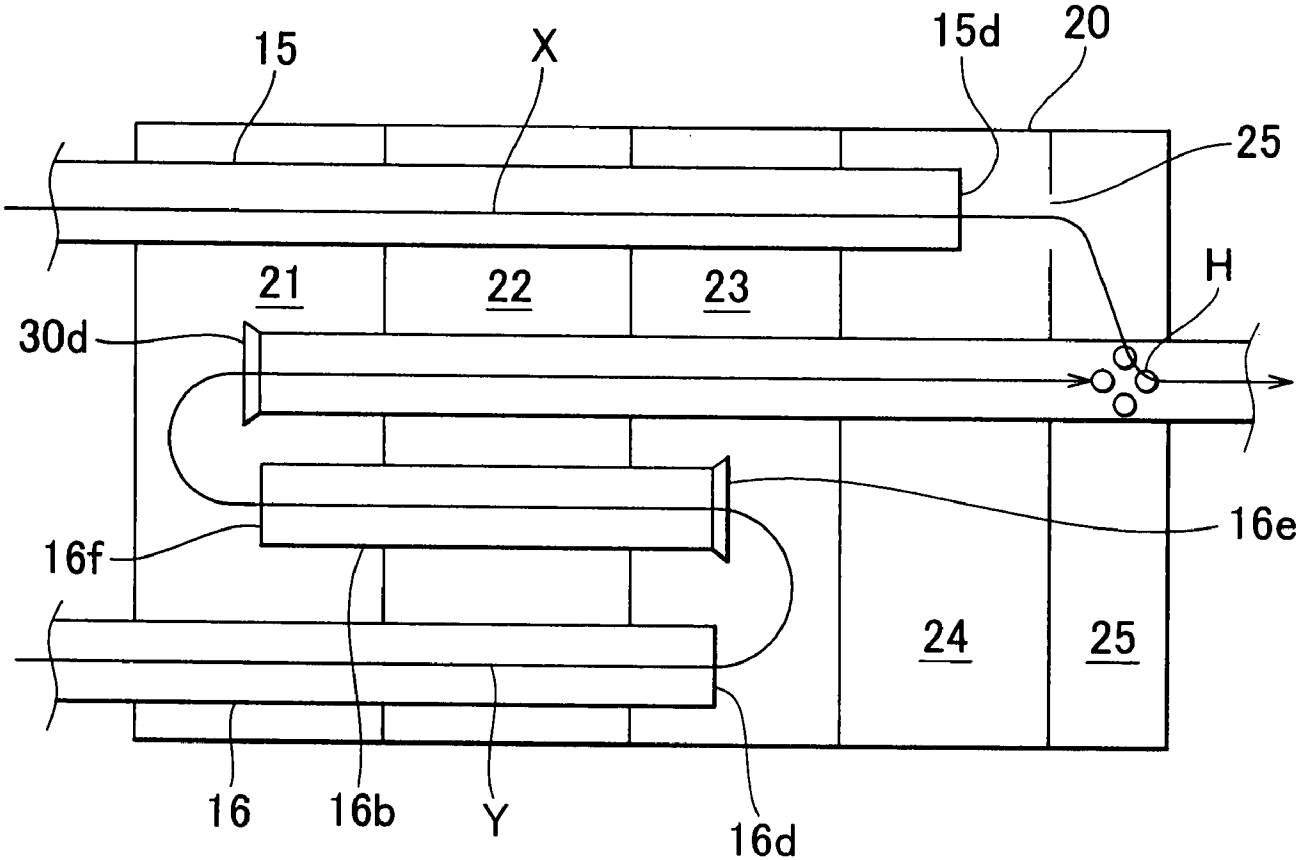
FIG. 2 is a horizontal cross sectional view that represents a part of the exhaust system around a muffler.

FIG. 2 is a horizontal cross sectional view of a peripheral part of the muffler 20 of the exhaust system 100. The inner portion of the muffler 20 is divided into five sections, which is similar to the structure of the generally employed muffler, that is, A section 21, B section 22, C section 23, D section 24, and F section 25 in the order from the upstream side. Conventionally the A section 21 functions as a resonance chamber, and B to F sections 22, 23, 24, 25 function as expansion chambers, respectively. The front pipe 15 is located such that its rear end portion 15*d* is positioned within the D section 24. The pipe 16*a* that constitutes the front pipe 16 is located such that its rear end portion 16*d* is positioned within the C section 23. The pipe 16*b* that constitutes the front pipe 16 passes across the B section 22 so as to communicate between the A and C sections 21, 23. The rear pipe 30 is located such that its front end portion 30*d* (inlet) is positioned within the A section 21, and is provided with a plurality of through holes H (inlets) formed in its pipe wall within the F section 24.

In the thus structured exhaust system 100, the exhaust gas discharged from the left and right banks of the engine is supplied into the muffler 20 via the exhaust manifolds 11, 12 and the front pipes 15, 16, respectively. The exhaust gas that passes through the front pipe 15 further flows in the arrowed direction X. That is, the exhaust gas passing through the front pipe 15 is discharged from the rear end portion 15*d* into the D section 24. The exhaust gas then flows into the F section 25 through a hole 25 formed in a partition wall that separates the D section 24 and the F section 25. It is further introduced into the rear pipe 30 via the through holes H so as to be discharged to an atmosphere.

As described above, the rear end portion 15*d* of the front pipe 15 is located near the through holes H formed in the rear pipe 30 such that the exhaust gas discharged from the front pipe 15 into the muffler 20 is substantially directly led to the rear pipe 30 without being resided in or flowing through the muffler 20. The original sound generated by the V-type engine may be transmitted to the rear pipe 30 via the front pipe 15 having its volume hardly decreased and its quality (tone) hardly changed. Accordingly powerful quality and volume of the exhaust sound that is close to the original sound generated by the V-type engine may be obtained.

The path length L1 of the front pipe 15 from the bank to the muffler 20 is shorter than the path length L2 of the front pipe 16 from the bank to the muffler 20. Accordingly the sound may be transmitted to the rear pipe 30 while maintaining the quality and volume to be closer to the original sound generated by the V-type engine.

Meanwhile the exhaust gas that has passed through the front pipe 16 flows in the arrowed direction Y. That is, the exhaust gas that has been passing through the front pipe 16 is discharged from the rear end portion 16*d* into the C section 23, and further fed from the rear end portion 16*e* of the front pipe 16*b* to the front end portion 16*f* thereof so as to flow into the A section 21. Then it is led from the front end portion 30*d* of the rear pipe 30 so as to be discharged into the atmosphere.

The exhaust gas that has been introduced into the muffler 20 through the front pipe 16 is fed into the rear pipe 30 via a path with relatively longer length rather than being substantially directly fed into the rear pipe 30. The path length L4 of the front pipe 16 within the muffler 20 is longer than the path length L3 of the front pipe 15 within the muffler 20.

This may allow the exhaust gas introduced from the front pipe 16 into the muffler 20 to easily generate the half order sound quality component. The adjustment of the sound quality or the volume of the allophone component makes it possible to finely adjust (tune) the powerful exhaust sound generated by the exhaust gas from the front pipe 15. The quality or volume of the allophone component such as the half order component is easily adjustable as the path length L1 is shorter than the path length L2 through the adjustment of the path length L4 of the front pipe 16 within the muffler 20.

FIGS. 3A to 3C and FIGS. 4A to 4C are horizontal cross sectional views each showing an embodiment of the exhaust system in which the path length L4 of the front pipe within the muffler 20 is changed. Referring to FIGS. 3A to 3C and FIGS. 4A to 4C, the rear pipe 31 (third exhaust pipe) extends straight in the muffler 20 in the same way as the rear pipe 30 but has no through hole H formed therein. Accordingly, the front end portion of the rear pipe 31 serves as the inlet. The front pipe 41 (first exhaust pipe) is located to substantially oppose the position around the front end portion of the rear pipe 31.

Figure 3A:
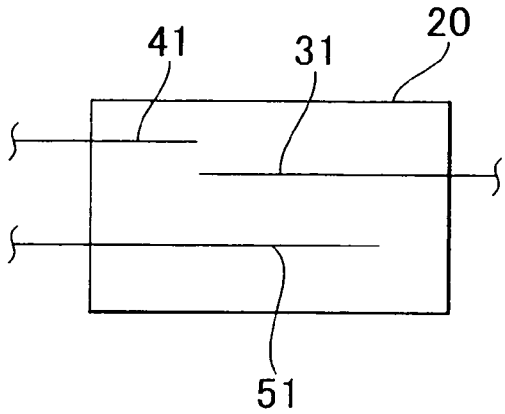
FIGS. 3A, 3B, and 3C are horizontal cross sectional views each showing a front pipe in the muffler with a different length.
Figure 3B:
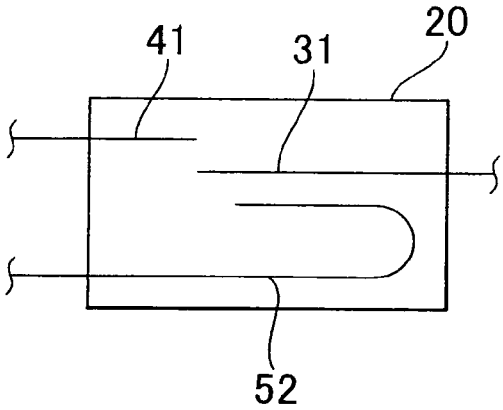
Figure 3C:
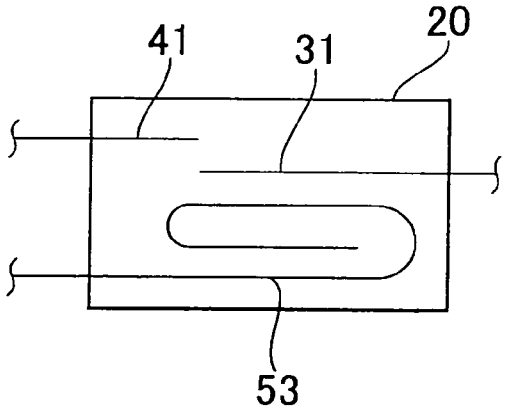
Figure 4A:
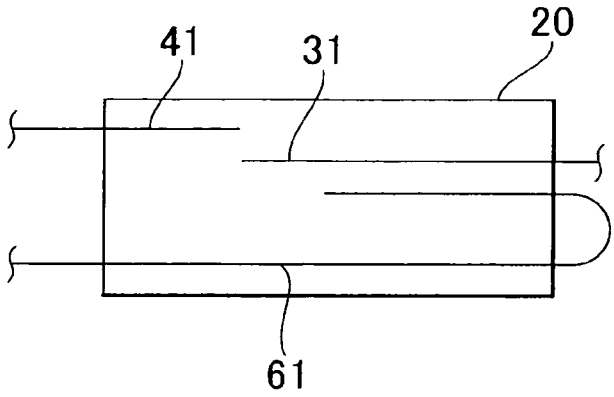
FIGS. 4A, 4B, and 4C are horizontal cross sectional views each showing the front pipe in the muffler with different length.
Figure 4B:
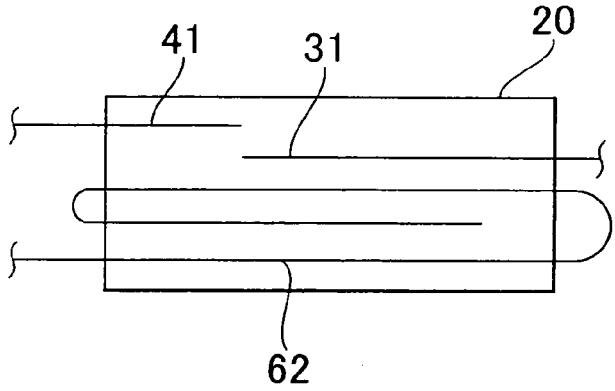
Figure 4C:
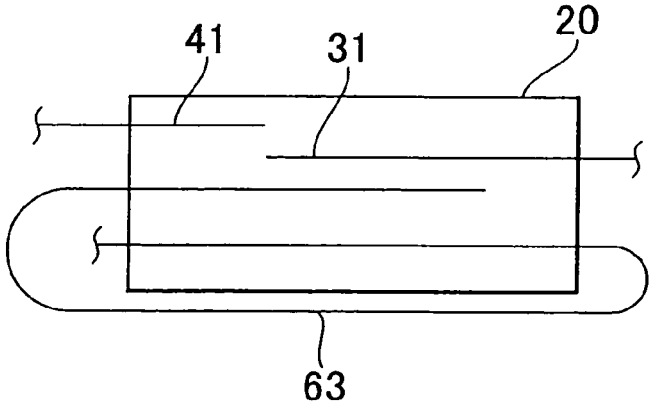

The front pipe (second exhaust pipe) 51 shown in FIG. 3A extends substantially straight in the muffler 20. The front pipe (second exhaust pipe) 52 shown in FIG. 3B is bent once within the muffler 20. The front pipe (second exhaust pipe) 53 shown in FIG. 3C is bent twice within the muffler 20. The exhaust systems shown in FIGS. 4A to 4C has structures in which each bent (curved) portion of the front pipes 61, 62, 63 is located outside of the muffler 20.

In this way, the total value of each length of the front pipes 16, 51 to 53, and 61 to 63 as the second exhaust pipe within the muffler 20 can be easily adjusted, allowing fine tuning of the exhaust sound.

In the exhaust system 100, the exhaust gas discharged from both left and right banks of the V-type engine joins in the single rear pipe 30 through the single muffler 20. This makes it possible to reduce the back pressure resulting from smooth exhaust flow. As the dual length (path length L1+L2) is likely to be kept substantially long, scavenging performance and charging efficiency of the exhaust gas may be improved, thus increasing the torque at the intermediate and low speed range of the V-type engine. The mechanical strength of the front pipe between the exhaust manifolds 11, 12 and the muffler 20 may be enhanced compared with the case where those two front pipes are bonded to the front of the muffler 20.

It is to be understood that the invention is not limited to the embodiment as aforementioned, but may be formed into various types of modifications so long as the scope of the invention is not changed. For example, the internal combustion engine provided with the exhaust system 100 may be of the other type having two banks such as the horizontally-opposed type engine. In the embodiment, the front pipe 16 is formed of two members, that is, pipes 16*a* and 16*b*. As shown in FIG. 3B, it may be formed of a single member having a bent portion, or may be formed of at least three types of members. Alternatively it may be formed of a plurality of members by dividing the front pipes 51 to 53, and 61 to 63 at appropriate points.

The structure of the inside of the muffler 20 is not limited to the one shown in the drawing. It is possible to attach a noise reducing material such as glass wool around the second exhaust pipe such as the front pipe 16. The catalytic converters 13 and 14 may be provided at the downstream side of the muffler 20.

In the exhaust system of the internal combustion engine according to the embodiment, the first exhaust pipe has its path length from the bank to the muffler shorter than that of the second exhaust pipe, and the rear end portion of the first exhaust pipe is located near the inlet of the third exhaust pipe. Accordingly the original sound generated by the engine may be directly transmitted to the third exhaust pipe so as to provide powerful exhaust sound as well as allow easy tuning of the powerful exhaust sound into the desired quality. The exhaust system, thus, may be widely applied to the equipment, devices and units of the vehicle provided with the exhaust system connected to the engine.

In the above-structured system, not only an opening at the front end portion of the third exhaust pipe but also holes formed on the wall thereof may serve as the inlet of the third exhaust pipe. The portion near the inlet of the third exhaust pipe represents the case where the exhaust path length from the rear end portion of the first exhaust pipe to the inlet of the third exhaust pipe is shorter than the total length of the exhaust passage through which the exhaust gas is fed into the third exhaust pipe through the second exhaust pipe within the bank. More specifically, preferably it may be equal to or shorter than ⅓ , and more preferably, ¼ of the total length of the muffler in the longitudinal direction. It is further preferable to locate the first exhaust pipe so that an opening at the rear end portion of the first exhaust pipe faces the inlet of the third exhaust pipe.

The appropriate adjustment of the path length of the second exhaust pipe within the muffler may allow generation of the other type of sound quality such as the half order sound by the engine where the positional relationship between the first and the third exhaust pipes is held without deteriorating the quality or volume of the original sound generated by the engine.

In the embodiment, the second exhaust pipe may be divided within the muffler. Accordingly the second exhaust pipe may be formed of a plurality of tubular members. In this case, the path length of the second pipe within the muffler may include the distance between the tubular members in addition to the total length of the tubular members. The path length of the second pipe within the muffler is substantially equal to the length of the exhaust passage (path length) to the third exhaust pipe through the second exhaust pipe within the muffler.

In the exhaust system according to the embodiment, the first exhaust pipe has its path length from the bank to the muffler is shorter than that of the second exhaust pipe, and the rear end portion of the first exhaust pipe is located near the inlet of the third exhaust pipe. This makes it possible to directly transmit the original sound generated by the engine so as to provide the powerful exhaust sound, and allow the powerful exhaust sound to be easily adjusted into the desired tone.

What is claimed is:

1. An exhaust system of an internal combustion engine comprising:

two banks provided in the internal combustion engine;

a first exhaust pipe and a second exhaust pipe, respectively, connected to a first and a second of the two banks;

a muffler connected to an exhaust side of the first and the second exhaust pipes; and a third exhaust pipe connected to the exhaust side of the muffler, wherein the first exhaust pipe has its path length (L1+L3) from the corresponding bank to a rear end portion being shorter than a path length (L2+L4) of the second exhaust pipe; and the rear end portion of the first exhaust pipe is located near an intake port of the third exhaust pipe.

2. The exhaust system according to claim 1, wherein the second exhaust pipe has its path length within the muffler longer than that of the first exhaust pipe within the muffler.

3. The exhaust system according to claim 1, wherein the third exhaust pipe has a through hole formed in its wall so as to be located near a rear end portion of the first exhaust pipe, through which an exhaust gas discharged from the first exhaust pipe is introduced into the third exhaust pipe.

4. The exhaust system according to claim 2, wherein the third exhaust pipe has a through hole formed in its wall so as to be located near a rear end portion of the first exhaust pipe, through which an exhaust gas discharged from the first exhaust pipe is introduced into the third exhaust pipe.

5. The exhaust system according to claim 1, wherein the second exhaust pipe is formed of a single member, and has at least one bent portion.

6. The exhaust system according to claim 2, wherein the second exhaust pipe is formed of a single member, and has at least one bent portion.

7. The exhaust system according to claim 3, wherein the second exhaust pipe is formed of a single member, and has at least one bent portion.

8. The exhaust system according to claim 4, wherein the second exhaust pipe is formed of a single member, and has at least one bent portion.

* * * * *